US006295053B1

(12) United States Patent
Tsai et al.

(10) Patent No.: US 6,295,053 B1
(45) Date of Patent: Sep. 25, 2001

(54) SYSTEM FOR REPROGRAMMING MONITOR FUNCTION

(75) Inventors: Te-Hsiu Tsai; Shih-Che Hsin, both of Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 09/414,251

(22) Filed: Oct. 7, 1999

(30) Foreign Application Priority Data

Jul. 19, 1999 (TW) ..... 88112204

(51) Int. Cl.[7] ..... G09G 5/00
(52) U.S. Cl. ..... 345/204; 345/10; 345/520
(58) Field of Search ..... 345/10, 22–24, 345/27, 112, 132, 198, 204, 418, 501, 507, 520–522, 526, 213

(56) References Cited

U.S. PATENT DOCUMENTS 4,660,170 * 4/1987 Hui et al. ..... 710/131
5,379,049 * 1/1995 Leach ..... 345/22
5,602,567 * 2/1997 Kanno ..... 345/132
5,691,741 * 11/1997 Kerigan et al. ..... 345/112
6,020,904 * 2/2000 Clark ..... 345/518
6,100,906 * 8/2000 Asaro et al. ..... 345/508
6,104,360 * 8/2000 Kim ..... 345/11

FOREIGN PATENT DOCUMENTS 0 303 138 A2 * 2/1989 (EP) ..... G09G/1/16

* cited by examiner

*Primary Examiner*—Richard Hjerpe
*Assistant Examiner*—Alexander Eisen
(74) *Attorney, Agent, or Firm*—Jiawei Huang; J.C. Patents

(57) ABSTRACT

A monitor control system capable of reprogramming the function of a monitor. The monitor control system utilizes VGA signal lines for video signal transmission during normal mode of operation and the same VGA signal lines for transmitting erase/record commands and data when the erasable programmable ROM inside the monitor demands reprogramming. Using an isolator circuit in the monitor control system for isolating an erase/record pathway of an erasable programmable ROM from a normal video pathway, data within the erasable programmable ROM can be modified without opening up the monitor casing. Hence, the modification of monitor function is much more convenient.

27 Claims, 5 Drawing Sheets

SYSTEM FOR REPROGRAMMING MONITOR FUNCTION

CROSS-REFERENCE TO RELATED APPLICATION

This application claims the priority benefit of Taiwan application serial no. 88112204, filed Jul. 19, 1999, the full disclosure of which is incorporated herein by reference.

BACKGROUND OF THE INVENTION

1. Field of Invention

The present invention relates to a system for reprogramming a monitor function. More particularly, the present invention relates to a monitor control system that utilizes the video graphic adapter (VGA) signal lines of a VGA card to reprogram a monitor function.

2. Description of Related Art

In the current most monitor systems, the monitor controller must be changed whenever monitor functions need to be modified or software bugs need to be removed. The process is laborious and wasteful. For more advanced monitor systems, the monitor systems usually have built-in read-only-memory (ROM) of the erasable programmable type. By modifying the internal data inside the erasable programmable ROM, modification of monitor function or correction of software bugs can be easier done.

FIG. 1 is a block diagram showing the circuit connections of various elements in a conventional programmable monitor system. The monitor is connected to a VGA card via a set of eight VGA signal lines 18. The VGA signal lines 18 include a vertical synchronous signal line (Vsync), a horizontal synchronous line (Hsync), a serial data line (SDA), a serial clock line (SCL), a ground (Gnd), a red R, a green G and a blue B line. In normal operation, a first jumper 14 is set such that the horizontal & vertical deflector 20 is connected to a monitor controller 10. In the meantime, a second jumper 16 is set such that an on-screen display 50 is also connected to the monitor controller 10. In addition, a power jumper 12 is set such that 5V are applied to the monitor controller 10. Signal lines Hsync, Vsync, SDA, SCL and Gnd are coupled to the monitor controller 10. The horizontal & vertical deflector 20 is driven according to the signals received through the signal lines and the programs stored inside the ROM unit of the monitor controller 10. The horizontal & vertical deflector 20 in turn controls a vertical booster 30 and a horizontal booster 40 so that an electronic beam is able to sweep horizontally and vertically inside a cathode ray tube (CRT). At the same time, the monitor controller 10 also drives the on-screen display 50. The on-screen display 50 controls an image pre-amplifier 60 for receiving red R, green G and blue B signals from the R, G and B lines. After passing through the pre-amplifier 60, signals are transferred to an image amplifier 70 for display on screen.

With the monitor system as shown in FIG. 1, any functional modification can be achieved by modifying the data inside the ROM unit of the monitor controller 10. However, before stored data inside the ROM unit can be changed, the monitor must be opened up and the first jumper 14 and the second jumper 16 must be reset. The jumpers 14 and 16 must be set such that the monitor controller 10 is connected to an erase/record socket 80 and the power jumper 12 is connected to a 12V input voltage. A ROM writer (not shown in the figure) is plugged into the erase/record socket for reprogramming the functions inside the monitor system.

FIG. 2 is a schematic view showing the connection of a conventional monitor system with a memory erase/record system. After the external casing of the monitor 100 is taken off, a main circuit board 110 is revealed. An erase/record socket 80 and a set of VGA signal lines 18 are laid on the circuit board 110. The first jumper 14, the second jumper 16 and the power jumper 12 are found within a jumper area 22. The memory erase/record system 90 includes a ROM writer 92, a computer system 94 and a programming monitor 96. The computer system 94 controls all the operations of the ROM writer 92. Programming status of the operation can be observed through the programming monitor 96. When the ROM writer is plugged into the erase/record socket 80 of the main circuit board 110, memory inside the monitor can be reprogrammed by the computer 94 so that a different monitor function can be used.

In brief, the external casing of a conventional monitor must be taken off and a set of jumpers must be switched before reprogramming can start, which is a laborious and inconvenient process.

SUMMARY OF THE INVENTION

The present invention provides a monitor control system capable of reprogramming monitor function. The monitor control system utilizes the VGA signal lines for transmitting signals during normal operation. The same VGA signal lines are also used for transmitting erase/record commands to the monitor system and to erase/record data into an erasable programmable ROM inside the monitor system.

To achieve these and other advantages and in accordance with the purpose of the invention, as embodied and broadly described herein, the invention provides a monitor controller for modifying a monitor function. The monitor controller is connected to VGA signal lines for receiving erase/record commands and data. The VGA signal lines are coupled first to a signal detector. The signal detector is able to detect or re-transmit erase/record commands and data. An activation device is connected to the signal detector. The activation device is capable of switching between a video pathway and an erase/record pathway. Furthermore, the activation device is able to pick up erase/record commands and data and re-route the commands and data to the erase/record pathway. A ROM erase/record command decoder is connected to the activation device via the erase/record pathway. The decoder translates incoming erase/record commands into erase/read/write signals and incoming data into address signals and data signals. The ROM unit connected to the ROM erase/record command decoder, so that program inside the ROM unit can be modified according to the incoming address signals, data signals and erase/read/write signals. A mode return device is connected to the ROM erase/record command decoder and the activation device, respectively. The mode return device is able to determine the status of data reprogramming inside the ROM unit according to the incoming address signals, data signals and read/write signals. As soon as the end of reprogramming is detected by the mode return device, a control signal is sent to the activation device switching back the connection from an erase/record pathway to a video pathway.

The invention also provides a monitor control system capable of reprogramming the function of a monitor. The monitor control system includes an erase/record device for storing and outputting erase/record commands and erase/record data. The erase/record device is connected to a set of VGA signal lines for transmitting erase/record commands and erase/record data. There is a monitor controller with a monitor-in-system programming ROM. The monitor controller, which has a ROM carrying a built-in program for the monitor system, is coupled to the VGA signal lines. According to the erase/record commands and data delivered through the VGA signal lines, program within the ROM unit of the monitor controller can be modified.

The invention also provides a method for reprogramming the memory inside a monitor system. Signals on the VGA signal lines are tapped continuously and compared with a pre-set address sequence. When one of the tapped consecutive address sequences matches that of a pre-set address sequence, a monitor in-system programming (MISP) mode is triggered inside the monitor system. As soon as programming mode is activated, an erase/record command is read and necessary actions are determined. When the erase/record command is for a write operation, erase/record data is read in and then written into the memory. After that, the next erase/record command is read in and appropriate actions are taken. When the erase/record command demands a return to non-programming mode, the monitor system returns to a normal mode of operation.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
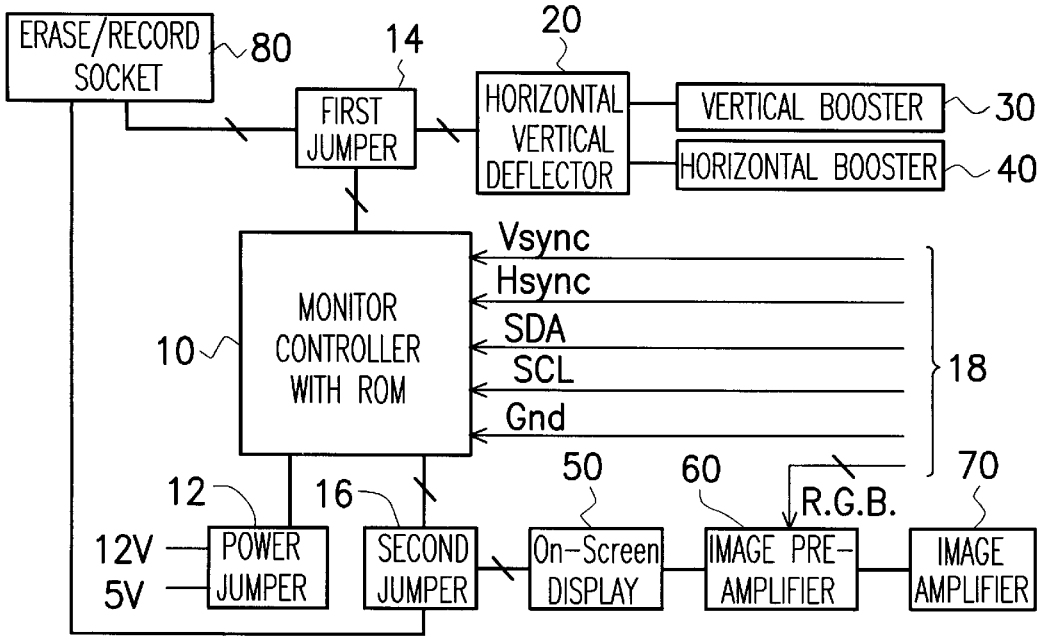
FIG. 1 (PRIOR ART)
FIG. 1 is a block diagram showing the circuit connections of various elements of a conventional programmable monitor system.
Figure 2:
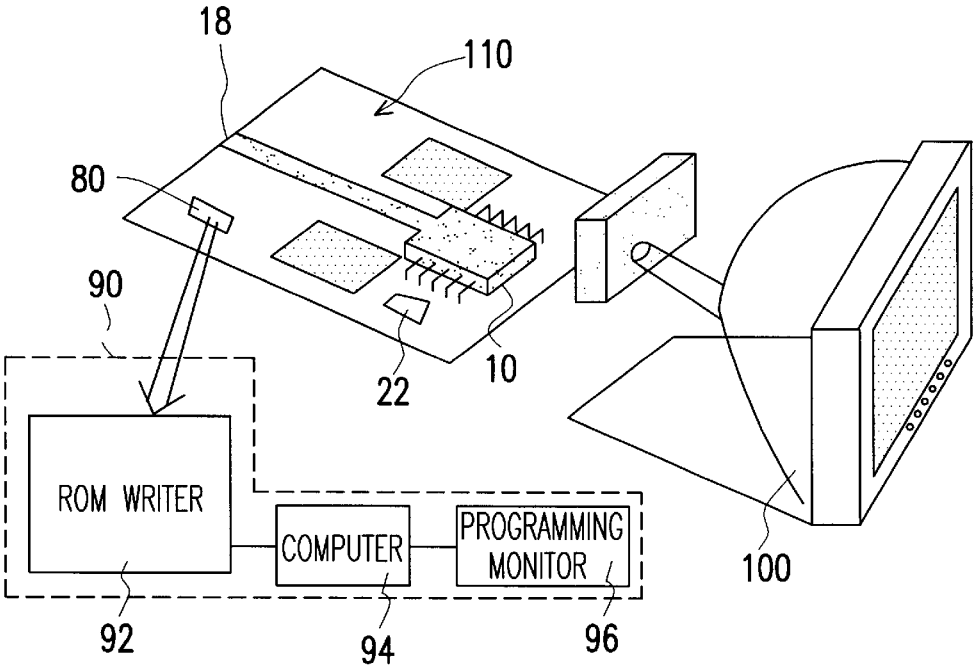
FIG. 2 (PRIOR ART)
FIG. 2 is a schematic view showing the connection of a conventional monitor system with a memory erase/record system.

Reference now be made in detail to the present preferred embodiments of the invention, examples of which are illustrated in the accompanying drawings. Wherever possible, the same reference numbers are used in the drawings and the description to refer to the same or like parts.

Figure 3:
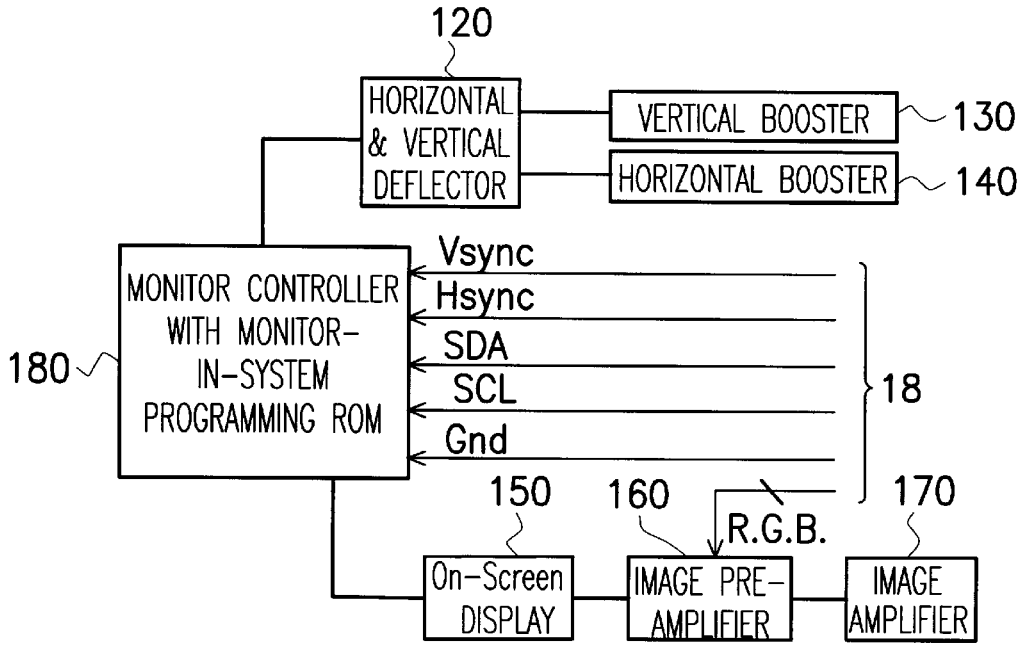
FIG. 3 is a block diagram showing the circuit connections of various elements of a programmable monitor system according to this invention.

FIG. 3 is a block diagram showing the circuit connections of various elements of a programmable monitor system according to this invention. As shown in FIG. 3, a set of VGA signal lines 18 is connected to a monitor controller 180 with a monitor-in-system programming ROM unit. According to the incoming signals from the signal lines 18 and the program stored inside the ROM unit, the monitor controller 180 is able to drive a horizontal & vertical deflector 120. The deflector 120 in turn activates a vertical booster 130 and a horizontal booster 140 so that an electron beam moves smoothly across a cathode ray tube (CRT), horizontally and vertically. In the meantime, the monitor controller 180 also drives an on-screen display 150. The on-screen display 150 in turn controls an image pre-amplifier 160 that receives a red R, a green G and a blue B signal. Signals from the image pre-amplifier 160 are next passed to an image amplifier 170. Finally, the image is displayed on the monitor screen.

To reprogram the function of the monitor system, all that is required is to modify the program data within the ROM unit of the monitor controller 180 by signaling through the set of VGA signal lines 18. Hence, there is no need to take off the external housing of a monitor for setting jumpers as in a conventional monitor system.

Figure 4:
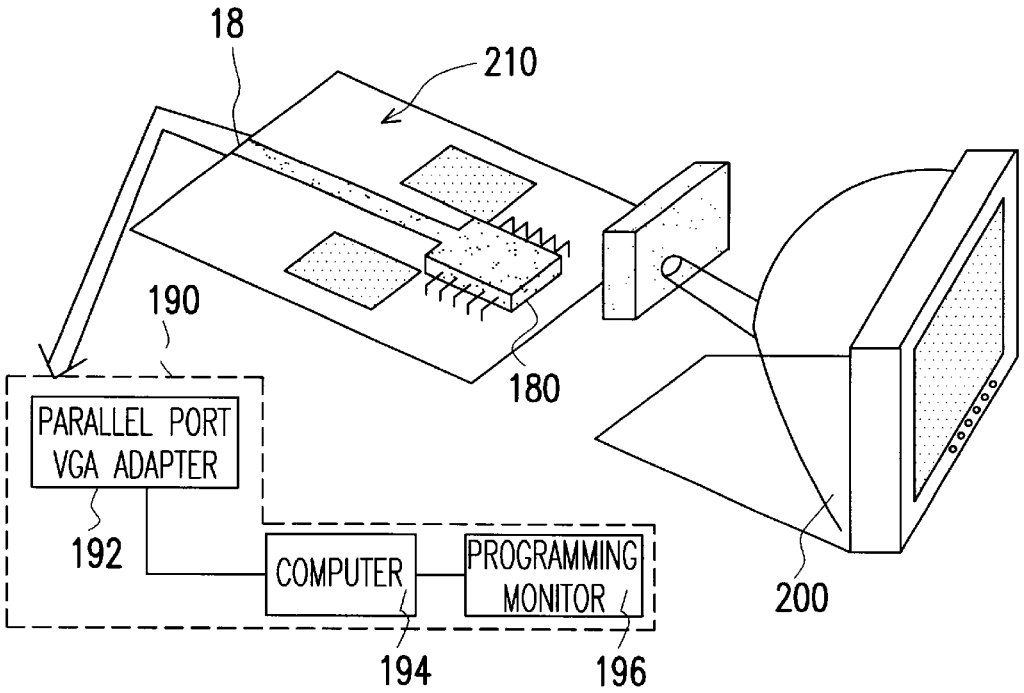
FIG. 4 is a schematic view showing the connection of a monitor system according to this invention with an erase/record device.

FIG. 4 is a schematic view showing the connection of a monitor system according to this invention with an erase/record device. As shown in FIG. 4, the main circuit board 210 inside a monitor 200 is connected to an erase/record device 190 via the set of VGA signal lines 18. To reprogram the function of the monitor, erase/record commands and erase/record data are first programmed into a computer system 194. The erase/record commands and data are translated into an inter-integrated circuit (IIC) interface format. The translated erase/record commands and data are output from a parallel port VGA adapter via the set of VGA signal lines into the ROM unit inside the monitor controller 180.

Alternatively, the erase/record device can utilize an IIC interface circuit platform. To reprogram the function of the monitor, erase/record commands and data are first written into the memory area of the IIC interface circuit platform. The erase/record commands and data are sent in the IIC interface format to the ROM inside the monitor controller 180 directly via the VGA signal lines.

In this embodiment of the invention, the serial data line SDA and the serial clock line SCL of the VGA signal lines are used to transmit erase/record commands and data in the IIC interface format. In practice, any two of the signal lines including SDA, SCL, Hsync and Vsync can be used for transmitting erase/record commands and data in the IIC interface format.

Figure 5:
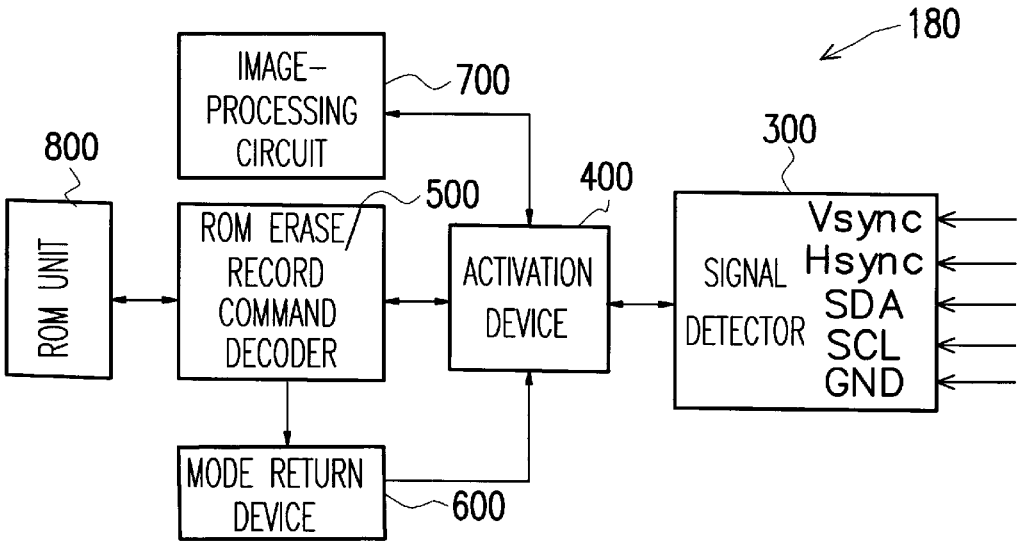
FIG. 5 is a block diagram showing the circuit connections of various internal elements of the monitor controller according to this invention.

FIG. 5 is a block diagram showing the circuit connections of various internal elements of the monitor controller according to this invention. The monitor controller 180, which carries a ROM with a built-in control program, includes a signal detector 300, an activation device 400, a ROM erase/record command decoder 500, a mode return device 600, image-processing circuits 700, which is the circuits other than the circuits belonging to the monitor controller 180, and a ROM unit 800.

VGA signal lines are connected to the signal detector 300. The signal detector 300 is a device for detecting any erase/record commands and data on the VGA signal lines. Signals are next delivered to the activation device 400.

The activation device 400 has a video pathway and an erase/record pathway. When erase/record commands are detected by the signal detector 300, the erase/record commands and data are re-directed to the ROM erase/record command decoder 500 via the erase/record pathway by the activation device 400. In the normal mode of operation, video signals are re-directed to the image-processing circuits 700 via the video pathway by the activation device 400.

The ROM erase/record command decoder 500 translates the erase/record commands into erase/read/write signals to be used by the ROM unit 800 and the erase/record data are also translated into addresses and data signals. The translated signals are the sent to the ROM unit 800 so that monitor function can be modified.

The ROM unit 800 stores a program code and data used for performing displaying function. The ROM unit 800 includes, for example, a flash ROM or electrical erasable programmable ROM (EEPROM). However, the program code can be erased and reprogrammed according to the address signals, data signals and erase/read/write signals picked up by the ROM unit.

The mode return device 600 is coupled to the ROM erase/record command decoder 500 and the activation device 400. According to address, data and read/write signals feedback from the decoder 500, progress in the reprogramming of ROM 800 can be determined. When the reprogramming is finished, the mode return device 600 signals to the activation device 400 so that connection to the video pathway is re-established.

In the following, elements and operation of each device is described in detail.

Figure 6:
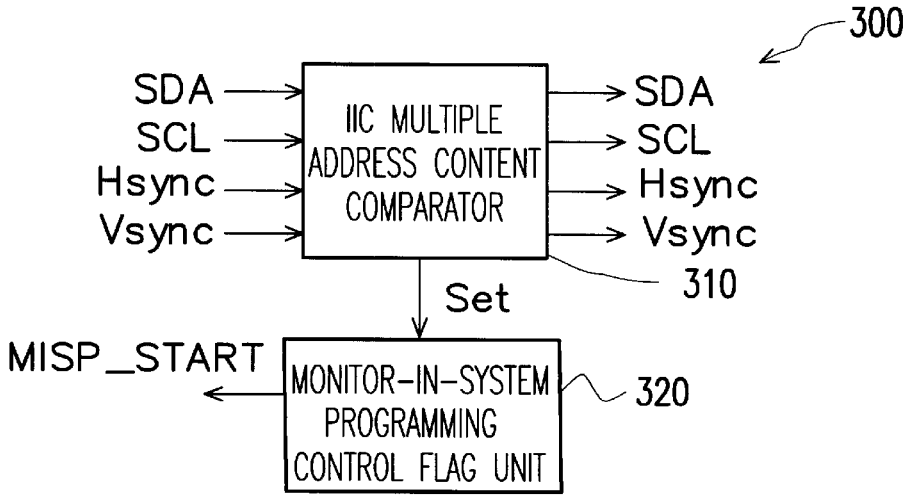
FIG. 6 is a block diagram showing the circuit connections of various internal elements of the signal detector according to this invention.

FIG. 6 is a block diagram showing the circuit connections of various internal elements of the signal detector according to this invention. The inter-integrated circuit multiple address content comparator 310 of the signal detector 300 taps the signals on the signal line SDA continuously, trying to match a pre-set address sequence. When the tapped consecutive address sequence matches that of the pre-set address sequence, a Set signal is sent to a monitor-in-system programming control flag unit 320. The transmission of a Set signal to the flag unit 320 indicates that reprogramming of the monitor system is desired. Consequently, a monitor-in-system programming start MISP_START signal is transmitted to the activation device 400.

Figure 7:
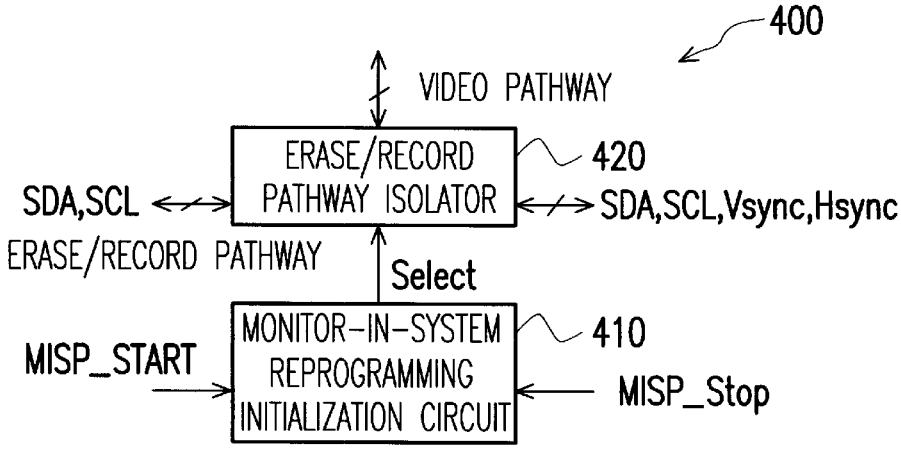
FIG. 7 is a block diagram showing the circuit connections of various internal elements of the activation device according to this invention.
Figure 8:
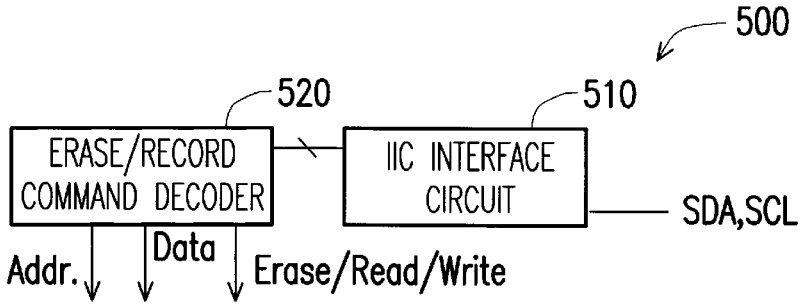
FIG. 8 is a block diagram showing the circuit connections of various internal elements of the ROM erase/record command decoder according to this invention.

FIG. 7 is a block diagram showing the circuit connections of various internal elements of the activation device according to this invention. As soon as the monitor-in-system reprogramming initialization circuit 410 of the activation device 400 picks up the MISP_START signal from the control flag unit 320, a Select signal is transmitted to an erase/record pathway isolator 420. On receiving the Select signal, the isolator 420 switches over the connection from the video pathway to the erase/record pathway so that erase/record commands and data signals is able to pass on. FIG. 8 is a block diagram showing the circuit connections of various internal elements of the ROM erase/record command decoder according to this invention. The IIC interface circuit 510 of the ROM erase/record command decoder 500 picks up the erase/record commands and data from the activation device 400. The erase/record commands and data are translated into an erase/record commands and data format compatible to the erase/record command decoder 520. The erase/record command decoder 520 converts the translated erase/record commands and data into address, data and erase/read/write signals. These address, data and erase/read/write signals are transmitted to the ROM 800 for reprogramming.

Figure 9:
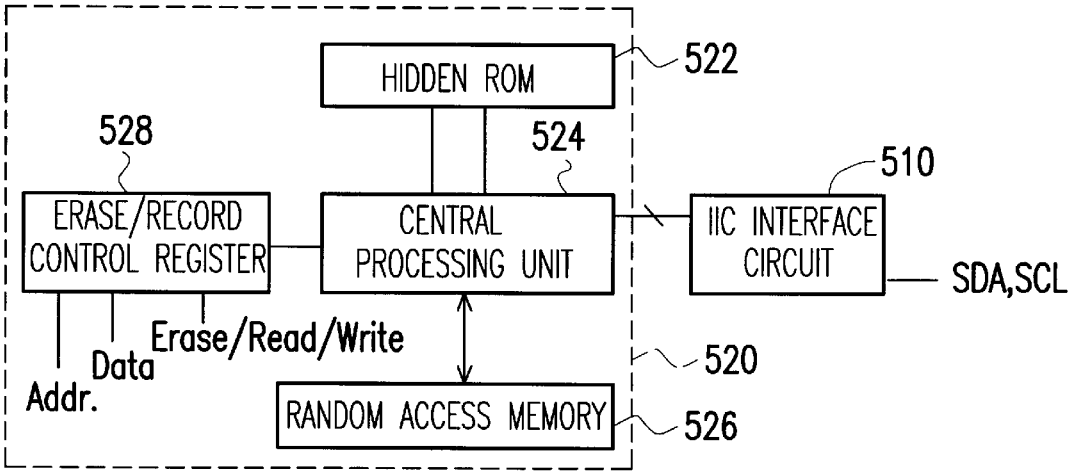
FIG. 9 is a block diagram showing the circuit connections of various internal elements of the erase/record command decoder.

FIG. 9 is a block diagram showing the circuit connections of various internal elements of the erase/record command decoder. The erase/record command decoder 520 includes a hidden ROM 522, a RAM unit 526, a central processing unit (CPU) 524 and an erase/record control register 528.

The hidden ROM 522 is a device for storing the program code of erase/record commands, and the RAM unit 526 is a device for storing erase/record data. The central processing unit 524 picks up the translated erase/record commands and data from the IIC interface circuit. The erase/record data is stored in the RAM unit 526. The erase/record commands are decoded using the decoding program inside the hidden ROM 522. The decoded erase/record commands are transmitted to an erase/record control register 528 where the commands are converted into ROM interface control signals or erase/read/write signals. The erase/record data stored in the RAM unit 526 is converted into address and data signals by the central processing unit 524.

The erase/record command decoder 520 can also be implemented using a hardware circuit. The erase/record commands picked up from the IIC circuit are divided into different states so that the commands can easily be converted into erase/read/write, address and data signals.

Figure 10:
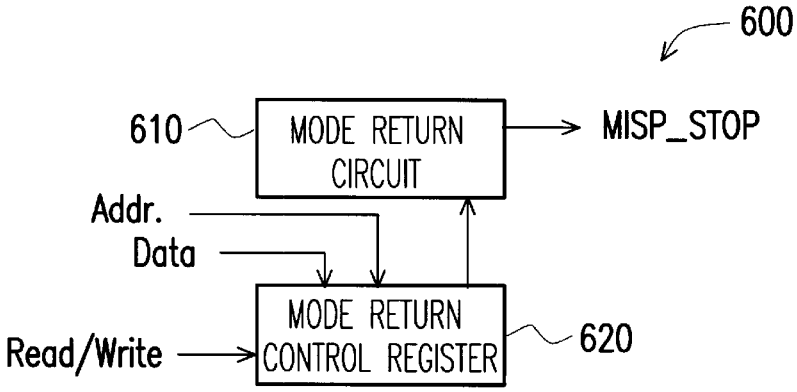
FIG. 10 is a block diagram showing the circuit connections of various internal elements of the mode return device.

FIG. 10 is a block diagram showing the circuit connections of various internal elements of the mode return device. The mode return register 620 of the mode return device 600 picks up feedback address, data and read/write signals from the erase/record control register 528. When the erase/record procedure is complete, a mode return signal is sent to the mode return circuit 610. As soon as the mode return circuit 610 picks up the mode return signal, a monitor-in-system programming MISP_STOP signal is issued to the activation device 400. The activation device 400 immediately switches over the connection from the erase/record pathway to the video pathway.

Figure 11:
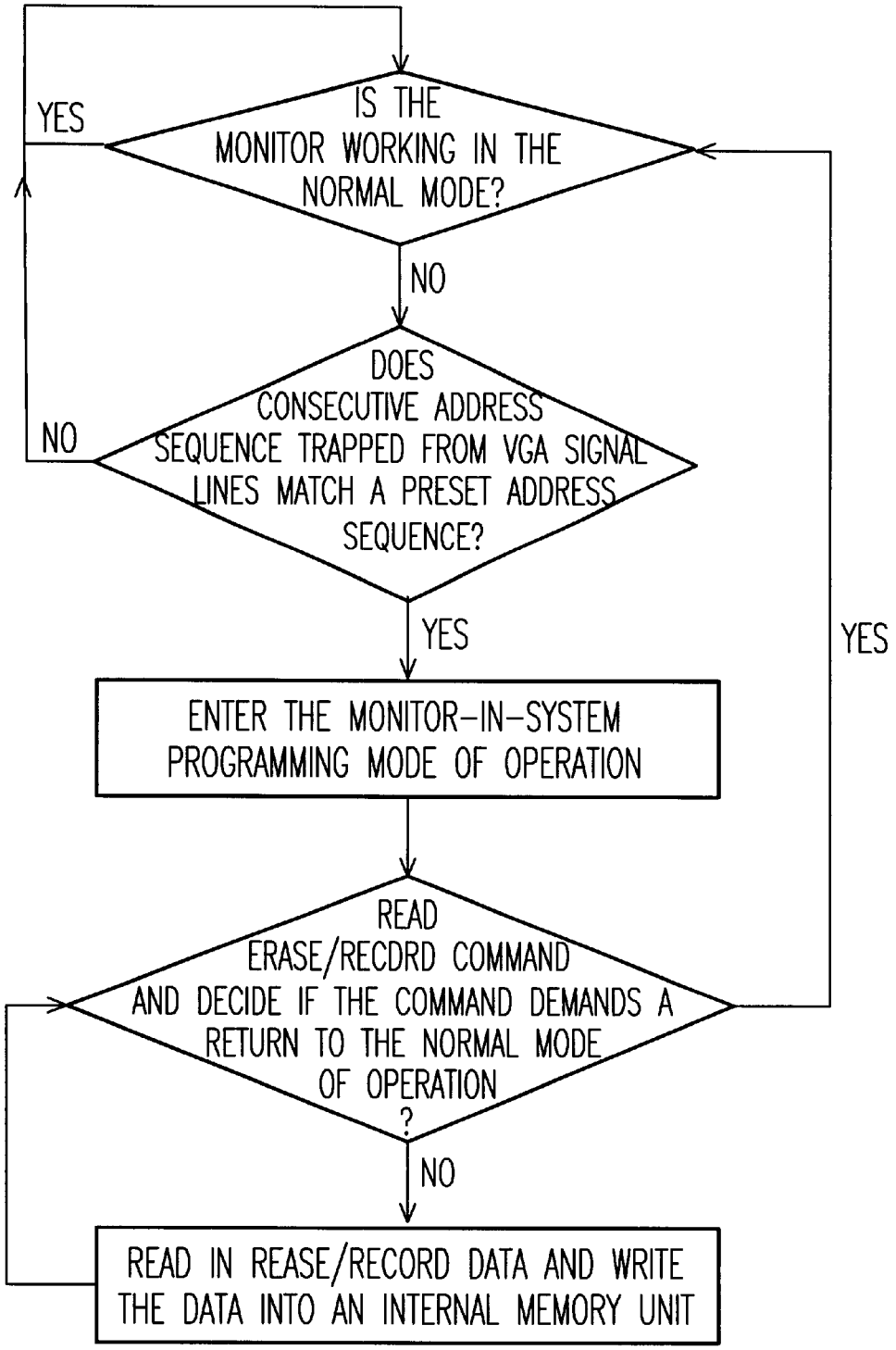
FIG. 11 is a flow chart showing the steps for reprogramming the memory inside a monitor system of this invention.

FIG. 11 is a flow chart showing the steps for reprogramming the ROM inside a monitor system of this invention. First, the monitor system monitors incoming signals repeatedly to check for anything abnormal. Nothing happens in the normal or the video transmission mode. When something abnormal is sensed by the monitor system, signals on the VGA signal lines are tapped and a consecutive address sequence is compared with a pre-set address sequence. If the tapped address does not match the pre-set address, the monitor system returns to a normal mode. However, if there is a match between the tapped address sequence and the pre-set address sequence, the monitor system enters a reprogramming mode. The incoming erase/record commands are checked by the monitor system. If the erase/record command demands that the system perform a memory write operation, erase/record data are written into the ROM unit inside the monitor controller. Thereafter, the next erase/record command is read. On the other hand, if the erase/record command demands a return to the normal mode of operation, the monitor system returns to the normal mode and mode checking is again carried out.

In summary, the invention provides a monitor control system capable of reprogramming the function of a monitor. The monitor control system utilizes the VGA signal lines for signal transmission in normal operation and the same VGA signal lines in the modification of data inside the erasable programmable ROM of a monitor controller in the reprogramming mode.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A device for reprogramming the function of a monitor, comprising:

a set of video graphic adapter (VGA) signal lines for transmitting a plurality of erase/record commands and a plurality of erase/record data;

a signal detector coupled to the VGA signal lines for detecting and re-transmitting the erase/record commands and data;

an activation device coupled to the signal detector, wherein the activation device is normally connected to a video pathway, but as soon as erase/record commands are detected, the activation device is switched to an erase/record pathway so that erase/record commands and data can be re-directed;

a read-only-memory (ROM) erase/record command decoder connected to the activation device via the erase/record pathway, wherein the decoder translates the erase/record commands into a plurality of erase/read/write signals and translates the erase/record data into a plurality of address signals and a plurality of data signals;

a ROM unit coupled to the ROM erase/record command decoder, so that data stored in the ROM unit can be modified data according to the address, data and erase/read/write signals coming from the command decoder; and a mode return device coupled to the ROM erase/record command decoder and the activation device, wherein the reprogramming status of the ROM unit can be determined from the address, data and read/write signals so that the activation device can be triggered to switch over connection from the erase/record pathway to the video pathway as soon as reprogramming is finished.

2. The device of claim 1, wherein the erase/record commands and data come from an erase/record device that couples to the VGA signal lines.

3. The device of claim 2, wherein the erase/record device is a computer platform that sends the erase/record commands and data in an inter-integrated circuit interface format via a parallel port VGA adapter.

4. The device of claim 2, wherein the erase/record device is an inter-integrated circuit interface circuit platform for transmitting erase/record commands and data in an inter-integrated circuit interface format.

5. The device of claim 1, wherein the signal detector further includes:

an inter-integrated circuit multiple address content comparator circuit coupled to the VGA signal lines for comparing with a plurality of consecutive address sequences in the erase/record data such that a set signal is transmitted when there is a match with a pre-set address sequence; and a monitor-in-system programming control flag unit coupled to the inter-integrated circuit multiple address content comparator circuit for transmitting a start signal after receiving the set signal.

6. The device of claim 1, wherein the activation device further includes:

a monitor-in-system reprogramming initialization circuit for producing a select signal after receiving the start signal; and an erase/record pathway isolator for switching over connection from the video pathway to the erase/record pathway after receiving the select signal and transmitting the erase/record commands and data via the erase/record pathway.

7. The device of claim 1, wherein the ROM erase/record command decoder further includes:

an inter-integrated interface circuit for receiving and translating the erase/record commands and data; and an erase/record command decoder for receiving translated erase/record commands and data and outputting address, data and erase/read/write signals.

8. The device of claim 7, wherein the erase/record command decoder further includes:

a hidden ROM for holding a program code for erase/record commands;

a random access memory (RAM) unit for holding erase/record data;

a central processing unit coupled to the hidden ROM, the RAM unit and the inter-integrated interface circuit, wherein the central processing unit receives the erase/record commands and data passing through the inter-integrated circuit interface circuit and then stores the erase/record data in the RAM unit, while the erase/record commands are decoded by referring to the program code in the hidden ROM and then the decoded commands are re-transmitted; and an erase/record control register coupled to the central processing unit for receiving the decoded erase/record commands and converting the erase/record commands into the interface control signals or erase/read/write signals, and converting the erase/record data stored in the RAM unit into address and data signals.

9. The device of claim 7, wherein the erase/record command decoder is a hardware circuit that separates each erase/record command picked up by the inter-integrated circuit into a plurality of states for ease of decoding and converts the erase/record commands and data into erase/read/write, address and data signals.

10. The device of claim 1, wherein the mode return device further includes:

a mode return control register for receiving the address, data and erase/read/write signals and producing a mode return signal as soon as a reprogramming operation is finished; and a mode return circuit coupled to the mode return control register and the activation device for sending a stop signal to the activation device after receiving the mode return signal so that the activation device switches over connection from the erase/record pathway back to the video pathway.

11. The device of claim 1, wherein the ROM unit comprises a flash ROM unit.

12. The device of claim 1, wherein the ROM unit comprises an erasable programmable ROM unit.

13. A system for reprogramming the function of a monitor, comprising:

an erase/record device for holding and transmitting a plurality of erase/record commands and a plurality of erase/record data;

a set of video graphic adapter (VGA) signal lines coupled to the erase/record device for transmitting the erase/record commands and data; and a monitor controller with a monitor-in-system programming read-only-memory (ROM) unit, wherein the monitor controller is coupled to the VGA signal lines so that data within the ROM unit can be modified according to the erase/record commands of the erase/record device and data coming from the erase/record device via the VGA signal lines.

14. The system of claim 13, wherein the erase/record device is a computer platform that sends the erase/record commands and data in an inter-integrated circuit interface format via a parallel port VGA adapter.

15. The system of claim 13, wherein the erase/record device is an inter-integrated circuit interface circuit platform for transmitting erase/record commands and data in an inter-integrated circuit interface format.

16. The system of claim 13, wherein the monitor controller with monitor-in-system programming ROM unit includes:

a signal detector coupled to the VGA signal lines for detecting and transmitting the erase/record commands and data;

an activation device coupled to the signal detector, wherein the activation device is normally connected to a video pathway, but as soon as erase/record commands is detected, the activation device is switched to an erase/record pathway so that erase/record commands and data can be re-directed;

a ROM erase/record command decoder connected to the activation device via the erase/record pathway, wherein the decoder translates the erase/record commands into a plurality of erase/read/write signals and translates the erase/record data into a plurality of address signals and a plurality of data signals;

a ROM unit erase/record command decoder coupled to the ROM erase/record command decoder, wherein data stored in the ROM unit can be modified according to the address, data and erase/read/write signals received from the command decoder; and a mode return device coupled to the ROM record command decoder and the activation device, wherein the reprogramming status of the ROM unit can be determined from the address, data and erase/read/write signals so that the activation device can be triggered to switch over connection from the erase/record pathway to the video pathway as soon as reprogramming is finished.

17. The system of claim 16, wherein the signal detector further includes:

an inter-integrated circuit multiple address content comparator circuit coupled to the VGA signal lines for comparing with a plurality of consecutive address sequences in the erase/record data such that a set signal is transmitted when there is a match with a pre-set address sequence; and a monitor-in-system programming control flag unit coupled to the inter-integrated circuit multiple address content comparator circuit for transmitting a start signal after receiving the set signal.

18. The system of claim 1, wherein the activation device further includes:

a monitor-in-system reprogramming initialization circuit for producing a select signal after receiving the start signal; and an erase/record pathway isolator for switching over connection from the video pathway to the erase/record pathway after receiving the select signal and transmitting the erase/record commands and data via the erase/record pathway.

19. The system of claim 16, wherein the ROM erase/record command decoder further includes:

an inter-integrated interface circuit for receiving and translating the erase/record commands and data; and an erase/record command decoder for receiving translated erase/record commands and data and outputting address, data and erase/read/write signals.

20. The system of claim 19, wherein the erase/record command decoder further includes:

a hidden ROM for holding a program code for erase/record commands;

a random access memory (RAM) unit for holding erase/record data;

a central processing unit coupled to the hidden ROM, the RAM unit and the inter-integrated interface circuit, wherein the central processing unit receives the erase/record commands and data passing through the inter-integrated circuit interface circuit and then stores the erase/record data in the RAM unit, while the erase/record commands are decoded by referring to the program code in the hidden ROM after which the decoded commands are re-transmitted; and an erase/record control register coupled to the central processing unit for receiving the decoded erase/record commands and converting the erase/record commands into the interface control signals or erase/read/write signals, and converting the erase/record data stored in the RAM unit into address and data signals.

21. The system of claim 19, wherein the erase/record command decoder is a hardware circuit that separates each erase/record command picked up by the inter-integrated circuit into a plurality of states for ease of decoding and converts the erase/record commands and data into erase/read/write, address and data signals.

22. The system of claim 16, wherein the mode return device further includes:

a mode return control register for receiving the address, data and read/write signals and producing a mode return signal as soon as a reprogramming operation is finished; and a mode return circuit coupled to the mode return control register and the activation device for sending a stop signal to the activation device after receiving the mode return signal so that the activation device switches connection from the erase/record pathway back to the video pathway.

23. The system of claim 16, wherein the ROM unit inside the monitor controller is a flash ROM unit.

24. The system of claim 16, wherein the ROM unit comprises an erasable programmable ROM unit.

25. A method for reprogramming the function of a monitor system, comprising the steps of:

tapping a plurality of signals from a set of video graphic adapter (VGA) signal lines to perform a plurality of consecutive address sequence comparisons with a pre-set address sequence;

triggering a programming mode inside the monitor system when one of the tapped consecutive address sequences matches that of the pre-set address sequence;

reading an erase/record command and deciding what actions to take as soon as the programming mode is activated;

reading in erase/record data and writing the erase/record data into a memory unit when the erase/record command is for a write operation, and then returning to the previous step; and returning to the very first step when the erase/record command demands a return to a non-programming mode.

26. The method of claim 25, wherein reprogramming starts only when the monitor system is not operating in a normal mode.

27. The method of claim 25, wherein the monitor system continues to operate in a normal video transmission mode when the tapped consecutive address sequence does not match any pre-set address sequence.

* * * * *